United States Patent [19]

Lamb et al.

[11] 4,447,315

[45] May 8, 1984

[54] HYDROCRACKING PROCESS

[75] Inventors: Paul R. Lamb, Lake Bluff; Steve T. Bakas, Palos Hills, both of Ill.; Brian M. Wood, Sasolburg, South Africa

[73] Assignee: UOP Inc., Des Plaines, Ill.

[21] Appl. No.: 487,797

[22] Filed: Apr. 22, 1983

[51] Int. Cl.[3] ..... C10G 67/06; C10G 25/03

[52] U.S. Cl. ..... 208/99; 208/48 R; 208/111; 208/310 R; 208/310 Z

[58] Field of Search ..... 208/48 R, 99, 111, 310 R, 208/310 Z, 96

[56] References Cited

U.S. PATENT DOCUMENTS

| | | | |
|---|---|---|---|
| 2,660,552 | 11/1953 | Blanding | 208/99 |
| 2,983,668 | 5/1961 | Hemminger | 208/95 |
| 3,619,407 | 11/1971 | Hendricks et al. | 208/48 R |
| 3,793,182 | 2/1974 | Ward | 208/111 |
| 3,882,013 | 5/1975 | Katsobashvili et al. | 208/60 |
| 4,111,791 | 9/1978 | Davis | 208/78 |
| 4,133,842 | 1/1979 | Anderson | 208/99 X |

*Primary Examiner*—Delbert E. Gantz
*Assistant Examiner*—O. Chaudhuri
*Attorney, Agent, or Firm*—James R. Hoatson, Jr.; John G. Cutts, Jr.; William H. Page, II

[57] ABSTRACT

A method is disclosed for hydrocracking a hydrocarbon feedstock having a propensity to form polynuclear aromatic compounds without excessively fouling the processing unit. The hydrocracking method includes contacting the hydrocarbon feedstock with a crystalline zeolite hydrocracking catalyst, contacting at least a portion of the resulting unconverted hydrocarbon oil containing polynuclear aromatic compounds with an adsorbent which selectively retains polynuclear aromatic compounds and recycling unconverted hydrocarbon oil having a reduced concentration of polynuclear aromatic compounds to the hydrocracking zone.

8 Claims, 1 Drawing Figure

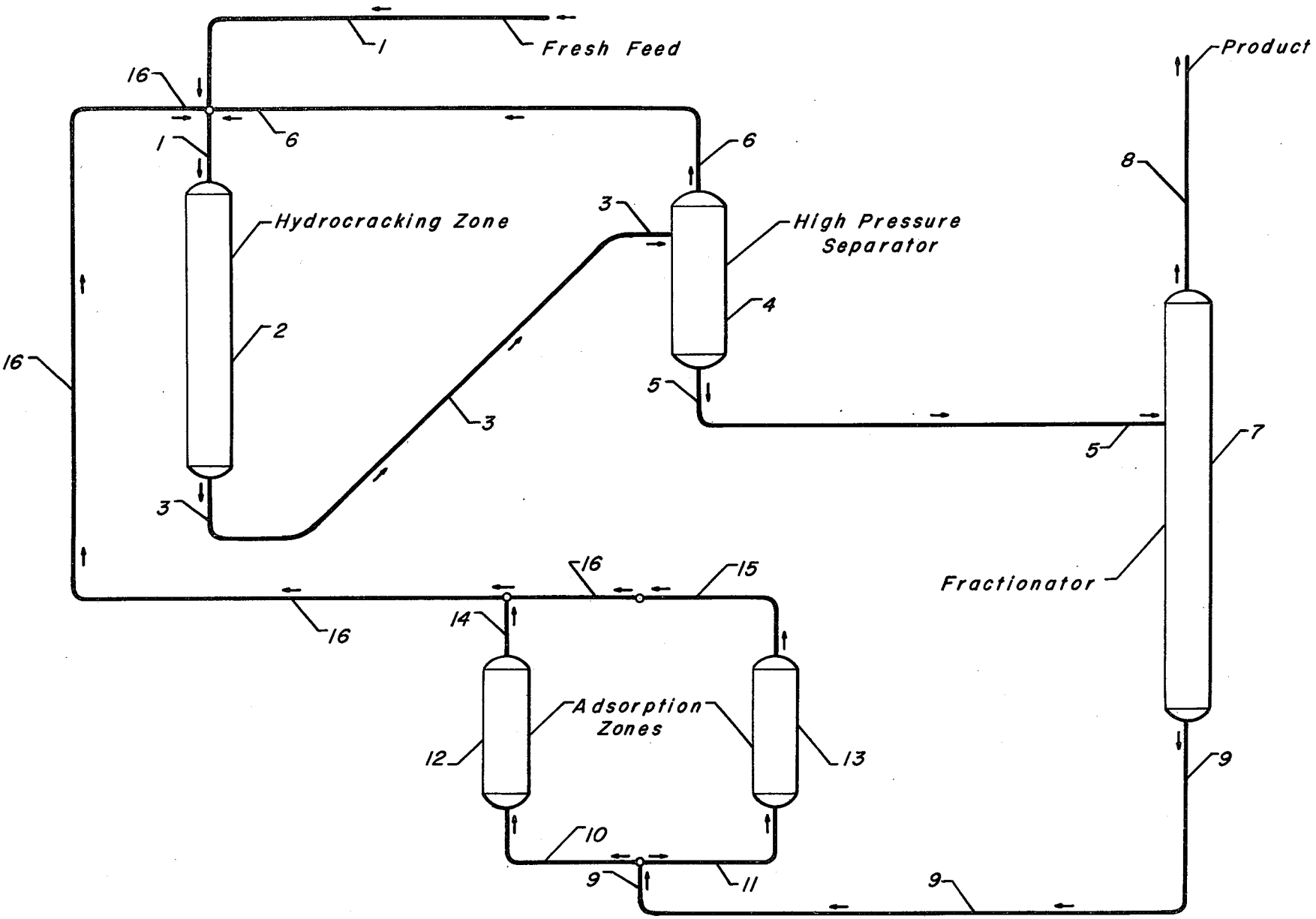
Product
Fresh Feed
High Pressure Separator
Hydrocracking Zone
Fractionator
Adsorption Zones
1
2
3
4
5
6
7
8
9
10
11
12
13
14
15
16

HYDROCRACKING PROCESS

FIELD OF THE INVENTION

The invention relates to the general field of catalytic hydrocracking of hydrocarbonaceous feedstocks into lower boiling hydrocarbon products. The invention is more directly related to a method of hydrocracking hydrocarbon feedstocks which have a propensity to form polynuclear aromatic compounds during hydroprocessing. A specific concern of the invention is the hydrocracking of hydrocarbons containing polynuclear aromatic compound precursors without excessively fouling the processing unit.

PRIOR ART

In U.S. Pat. No. 3,619,407, (Hendricks et al) a process is claimed to prevent fouling of the equipment in a hydrocracking process unit which comprises partially cooling the effluent from the hydrocracking zone to effect condensation of a minor proportion of the normally liquid hydrocarbons therein, thereby forming a polynuclear aromatic rich partial condensate and withdrawing a bleedstream of the partial condensate. The '407 patent acknowledges as prior art that the hereinabove mentioned fouling problem may also be solved by subjecting the recycle oil (the heavy portion of the hydrocracking zone effluent), or a substantial portion thereof, to atmospheric distillation or vacuum distillation to separate out a heavy bottoms fraction containing polynuclear aromatics (PNA or benzcoronenes). This however leads to a substantial increase in capital costs, as well as increased operating expenses attendant upon the high heat load required to distill overhead about 90 to 99 percent of the recycle oil.

The solution to the problem taught by '407 avoids expensive-distillation loads and resides in bleeding a portion of the recycle oil from the system and diverting it to other uses. This solution however is undesirable from several standpoints. Firstly, the size of the bleedstream must be substantial, at least during the terminal portion of the run, in order to keep the benzcoronene concentration throughout the system at sufficiently low levels as not to exceed solubility limits. This entails a substantially reduced yield of desired low-boiling products. Secondly, since the concentration of benzcoronenes in a hydrorefined feedstock generally increases substantially during a hydrocracking run (as a result of increasing severity in the hydrofiner), the size of the bleedstream required to maintain desired benzcoronene levels in the hydrocracking system will vary substantially over the run, entailing varying total feed rates to the reactor and resultant process control problems. The process claimed in the '407 patent also requires a high pressure rated vessel to collect the partial condensation liquid and the assorted piping and level controls to withdraw the condensed liquid from the system. Once the condensed liquid is withdrawn, a significant amount of heavy hydrocarbons contaminated with benzcoronenes must be disposed of in an environmentally safe manner. Such disposal is generally not a minor expense.

The prior art teaches that polynuclear aromatic compounds may be selectively adsorbed on suitably selected adsorbents. The classical adsorbents which demonstrate high adsorptivity for polynuclear aromatic compounds include alumina and silica gel. Other polynuclear aromatic compound adsorbents include cellulose acetate, synthetic magnesium silicate, macroporous magnesium silicate, macroporous polystyrene gel and graphitized carbon black. All of the above-mentioned adsorbents are mentioned in a book authored by Milton L. Lee et al entitled "Analytical Chemistry of Polycyclic Aromatic Compounds" and published by Academic Press, New York in 1981.

The present invention achieves removal of the undesirable polynuclear aromatic compounds without the shortcomings of the above discussed prior art.

SUMMARY OF THE INVENTION

One embodiment of the present invention is a catalytic hydrocracking process which comprises: (a) contacting a hydrocarbon feedstock having a propensity to form polynuclear aromatic (PNA) compounds in a hydrocracking zone with added hydrogen and a metal promoted crystalline zeolite hydrocracking catalyst at elevated temperature and pressure sufficient to give a substantial conversion to lower boiling products; (b) condensing the hydrocarbon effluent from the hydrocracking zone to provide a liquid hydrocarbon product and unconverted hydrocarbon oil containing trace quantities of polynuclear aromatic compounds; (c) contacting at least a portion of the unconverted hydrocarbon oil containing polynuclear aromatic compounds with an adsorbent which selectively retains the polynuclear aromatic compounds; and (d) recycling unconverted hydrocarbon oil having a reduced concentration of polynuclear aromatic compounds resulting from step (c) to the hydrocracking zone.

Other embodiments of the present invention encompass further details such as types of feedstocks, catalysts, adsorbents, and preferred operating conditions including temperature and pressures, all of which are hereinafter disclosed in the following discussion of each of these facets of the invention.

BRIEF DESCRIPTION OF THE DRAWING

The drawing shows diagrammatically one embodiment of the present invention. More particularly a system is shown which comprises an adsorption zone for effecting the removal of polynuclear aromatic compounds (PNA) from the recycle stream in a hydrocracking process unit. The above described drawing is intended to be schematically illustrative of the present invention and not be a limitation thereof.

DETAILED DESCRIPTION OF THE INVENTION

We have discovered that a total recycle of unconverted oil can be maintained indefinitely in the above described hydrocracking process units without encountering the above noted fouling or precipitation problems and without increasing distillation loads or without withdrawing a small bleedstream of a benzcoronene-rich partial condensate of the reactor effluent as taught in U.S. Pat. No. 3,619,407 (Hendricks et al) by contacting a least a portion of the unconverted hydrocarbon oil or recycle stream containing polynuclear aromatic compounds with an adsorbent which selectively retains polynuclear aromatic compounds. According to the present invention, essentially all of the polynuclear aromatic compounds may be removed from the recycle hydrocarbon stream thereby drastically minimizing the concentration of foulant material.

As mentioned above, the prior art has described adsorbents which are selective towards polynuclear aromatic compounds but it is believed that the prior art has not recognized the usefulness of incorporating adsorbents in a hydrocracking process as described in the present invention. Additionally, it is believed that the prior art has failed to teach the use of adsorbents to selectively remove polynuclear aromatic compounds from a liquid hydrocarbon recycle stream in a hydrocracking process.

In some cases where the concentration of foulants is small, only a portion of recycle hydrocarbon oil may need to be contacted with adsorbent in order to maintain the foulants at concentrations levels below that which promotes precipitation and subsequent plating out on heat exchanger surfaces.

Broadly speaking, any mineral oil feedstocks may be employed in the hydrocracking process of the present invention which oil contains polynuclear aromatic compounds or their precursors in an amount sufficient to result in a buildup thereof to levels above their solubility limit in the process streams. The most serious fouling problems are encountered when crystalline zeolite catalyst, as described hereinafter, are employed. In some cases, foulant concentrations as low as one weight part per million (WPPM) may be sufficient to result in such undesirable buildup, although in general amounts greater than about 5 WPPM are required. The troublesome polynuclear aromatic compounds are defined herein as any fused-ring polycyclic aromatic hydrocarbons containing a coronene nucleus and fused thereto at least one additional benzo-ring.

Although these aromatic compounds are very high boiling materials it is not to be assumed that they are found only in hydrocarbon oil of similarly high end boiling points (as determined by conventional ASTM methods). Since the limit of solubility of these compounds is thought to be between about 10 and 1000 WPPM, their presence in hydrocarbon oil has little, if any, effect upon the end boiling points as determined by conventional methods. Hence, it may be found that feedstocks with end boiling points as low as about 500° F. may contain these troublesome foulants.

Suitable hydrocarbon feedstocks for the present invention are, for example, gas oil, vacuum gas oil, cycle oil, and mixtures thereof.

Preferred catalysts for use in the present invention comprise in general any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves, and are usually composed of silica, alumina and one or more exchangeable cations such as sodium, hydrogen, magnesium, calcium, rare earth metals, etc. They are further characterized by crystal pores of relatively uniform diameter between about 4 and 14Å. It is preferred to employ zeolites having a relatively high silica/alumina mole ratio between about 3 and 12, and even more preferably between about 4 and 8. Suitable zeolites found in nature include for example mordenite, stilbite, heulandite, ferrierite, dachiardite, chabazite, erionite and faujasite. Suitable synthetic zeolites include for example the B, X, Y and L crystal types or synthetic forms of the natural zeolites noted above, e.g., synthetic faujasite and mordenite. The preferred zeolites are those having crystal pore diameters between about 8–12 Å, wherein the silica/alumina mole ratio is about 4 to 6. A prime example of a zeolite falling in this preferred group is synthetic Y molecular sieve.

The natural occurring zeolite are normally found in a sodium form, an alkaline earth metal form, or mixed forms.

The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially backexchanging with a polyvalent metal salt and then calcining. In some cases, as in the case of synthetic mordenite, the hydrogen forms can be prepared by direct acid treatment of the alkali metal zeolites. The preferred cracking bases are those which are a least about 10 percent, and preferably at least 20 percent, metal-cation-deficient, based on the initial ion-exchange capacity. A specifically desirable and stable class of zeolites are those wherein at least about 20 percent of the ion-exchange capacity is satisfied by hydrogen ions.

The active metals employed in the catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

In accordance with the present invention, a portion of the unconverted hydrocarbon oil containing polynuclear aromatic compounds is contacted with a suitable adsorbent which selectively retains the polynuclear aromatic compounds. Suitable adsorbents may be selected from materials which exhibit the primary requirement of polynuclear aromatic compound selectivity and which are otherwise convenient to use. Suitable adsorbents include, for example, molecular sieves, silica gel, activated carbon, activated alumina, silica-alumina gel, and clays. Of course, it is recognized that for a given case, a particular adsorbent may give better results than others.

The selected adsorbent is contacted with the hydrocarbon containing polynuclear aromatic compounds in an adsorption zone. The adsorbent may be installed in the adsorption zone in any suitable manner. A preffered method for the installation of the adsorbent is in a fixed bed arrangement. The adsorbent may be installed in one or more vessels and in either series or parallel flow. The flow of hydrocarbons through the adsorption zone is preferably performed in a parallel manner so that when one of the adsorbent beds or chambers is spent by the accumulation of polynuclear aromatic compounds thereon, the spent zone may be bypassed while continuing uninterrupted operation through the parallel zone. The spent zone of adsorbent may then be regenerated or the spent adsorbent may be replaced as desired.

The adsorption zone is maintained at a pressure from about 10 psig to about 600 psig, preferably from about 25 psig to about 500 psig, a temperature from about 50° F. to about 600° F., preferably from about 100° F. to about 500° F. and a liquid hourly space velocity from about 0.1 to about 500, preferably from about 0.5 to about 400. The flow of the hydrocarbons through the adsorption zone may be conducted in an upflow, downflow or radial flow manner. The temperature and pressure of the adsorption zone are preferably selected to maintain the hydrocarbons in the liquid phase. The resulting unconverted hydrocarbon oil having a reduced concentration of polynuclear aromatic compounds is then recycled to the hydrocracking zone for further processing and subsequent conversion to lower boiling hydrocarbons.

Reference is now made to the accompanying drawing for a more detailed description and illustration of the invention. In the drawing, fresh feed hydrocarbon is introduced to hydrocracking zone 2 via conduit 1. A gaseous hydrogen stream as hereinbelow described is introduced to hydrocracking zone 2 via conduits 6 and 1. A recycle hydrocarbon oil having a reduced concentration of polynuclear aromatic compounds as hereinafter described is introduced to hydrocracking zone 2 via conduits 16 and 1. The admixture of fresh feed hydrocarbon, recycle hydrocarbon oil and gaseous hydrogen is reacted in hydrocracking zone 2 at conditions sufficient to convert at least a portion of the fresh feed hydrocarbon to lower boiling hydrocarbons. Hydrocracking zone 2 is packed with one or more beds of zeolite hydrocracking catalyst as hereinabove described. Suitable hydrocracking conditions for hydrocracking zone 2 may vary within the following ranges:

| Hydrocracking Conditions | | |
|---|---|---|
| | Broad Range | Preferred Range |
| Temperature, °F. | 450–850 | 500–775 |
| Pressure, psig | 500–4000 | 1000–3000 |
| LHSV | 0.2–20 | 0.5–10 |
| Hydrogen Circulation, SCFB | 2000–20,000 | 2000–10,000 |

The effluent from hydrocracking zone 2 is withdrawn via conduit 3 and cooled to condense the normally liquid hydrocarbons by a heat exchange means which is not shown. The condensed hydrocracking zone effluent is introduced into high pressure separator 4 via conduit 3. A gaseous hydrogen-rich stream is withdrawn from high pressure separator 4 via conduit 6 and recycled to hydrocracking zone 2 via conduits 6 and 1.

The condensed normally liquid hydrocarbons are removed from high pressure separator 4 via conduit 5 and transferred to fractionator 7. In fractionator 7, the desired hydrocarbon product is separated and recovered via conduit 8. A heavy hdyrocarbon fraction having a boiling range greater than the hydrocarbon product and containing polynuclear aromatic compounds is separated in fractionator 7 and withdrawn via conduit 9 as a recycle stream. The hydrocarbon recycle stream is transferred via conduits 9 and 11 to adsorption zone 13 which contains a suitable adsorbent for the removal of trace quantities of polynuclear aromatic compounds from the hydrocarbon recycle stream. Particularly preferred adsorbents are described hereinabove. A hydrocarbon recycle stream having a reduced concentration of polynuclear aromatic compounds is transferred from adsorption zone 13 via conduits 15, 16 and 1 to hydrocracking zone 2. Alternatively, the hydrocarbon recycle stream is transferred via conduits 9 and 10 to adsorption zone 12. A hydrocarbon recycle stream having a reduced concentration of polynuclear aromatic compounds is transferred from adsorption zone 12 via conduits 14, 16 and 1 to hydrocracking zone 2. The configuration of adsorption zones so as to maximize the utility of the present invention is discussed and described hereinabove.

The following illustrative embodiment is presented to illustrate the process of the present invention and is not intended as an undue limitation on the generally broad scope of the invention as set out in the appended claims. The following data were not obtained by the actual performance of the present invention, but are considered prospective and reasonably illustrative of the expected performance of the invention.

ILLUSTRATIVE EMBODIMENT

This illustration describes a preferred embodiment of the present invention.

The selected feedstock is a heavy vacuum gas oil. This feedstock has a gravity of 20° API, an initial boiling point of 500° F., a 50% boiling point of 900° F. and a 90% boiling point of greater than about 1050° F. The feedstock contains 2.7 weight percent sulfur and 0.2 weight percent nitrogen.

A stream in the amount of 40,000 barrels per day of fresh feed is introduced to a hydrocracking zone in admixture with hydrogen in an amount of 10,000 standard cubic feet per barrel (SCFB) of feedstock and 15,000 barrels per day of a recycle hydrocarbon stream which is hereinafter described.

The feedstock, liquid hydrocarbon recycle and hydrogen is then contacted with two fixed beds of catalyst in a hydrocracking zone. The first bed of catalyst comprises a silica-alumina support containing nickel and tungsten and is operated at a liquid hourly space velocity of about 0.5 and an average catalyst temperature of about 725° F. The second bed of catalyst comprises an alumina-zeolite Y support containing nickel and tungsten and is operated at a liquid hourly space velocity of about 1 and an average catalyst temperature of about 660° F. Both beds of catalyst are operated at a pressure of about 2400 psig. The effluent from the catalyst beds is cooled to about 120° F. and then is passed to the high pressure separator which is maintained at about 2000 psig. A hydrogen-rich gaseous stream is removed from the high pressure separator and recycled together with fresh make-up hydrogen to the hydrocracking zone. The liquid hydrocarbons from the high pressure separator are charged to a fractionator wherein hydrocarbons boiling below about 650° F. are separated and withdrawn as product. A summary of the product yields is presented in the table.

TABLE

Summary of Product Yields

| | Weight Percent |
|---|---|
| Chargestock | |
| Fresh Feed | 100 |
| Hydrogen | 3 |
| Total | 103 |
| Products | |
| Ammonia | 0.2 |
| Hydroqen Sulfide | 2.9 |
| Light Gaseous Hydrocarbons | 6.0 |
| Light & Heavy Naphtha | 45.8 |
| Kerosene | 17.7 |
| Light Diesel Oil | 11.5 |
| Heavy Diesel Oil | 18.9 |
| Total | 103.0 |

The hydrocarbons boiling at a temperature greater than about 60° F. are withdrawn from the fractionator and are hereinafter referred to as recycle hydrocarbon. This recycle hydrocarbon is found to contain about 150 WPPM polynuclear aromatic compounds and is contacted in a downflow configuration with a fixed bed of activated carbon adsorbent at conditions which include a liquid hourly space velocity of about 3, a temperature of about 175° F. and a pressure of about 225 psig. After the recycle hydrocarbon has been contacted with the adsorbent, the concentration of polynuclear aromatic compounds has been reduced by about 97 percent and the resulting low-contaminant recycle hydrocarbon is then introduced together with fresh feedstock and hydrogen into the hydrocracking zone as mentioned above.

The foregoing description, drawing and illustrative embodiment clearly illustrate the improvements encompassed by the present invention and the benefits to be afforded an improved hydrocracking process for the conversion of hydrocarbonaceous charge stock.

We claim:

1. A catalytic hydrocracking process which comprises:
   (a) contacting a hydrocarbon feedstock having a propensity to form polynuclear aromatic (PNA) compounds in a hydrocracking zone with added hydrogen and a metal promoted crystalline zeolite hydrocracking catalyst at elevated temperature and pressure sufficient to give a substantial conversion to lower boiling products;
   (b) condensing the hydrocarbon effluent from said hydrocracking zone and separating the same into a low boiling hydrocarbon product and unconverted hydrocarbon oil boiling above about 650° F. and containing trace quantities of polynuclear aromatic compounds:
   (c) contacting at least a portion of said unconverted hydrocarbon oil containing polynuclear aromatic compounds with an adsorbent which selectively retains said polynuclear aromatic compounds; and
   (d) recycling unconverted hydrocarbon oil having a reduced concentration of polynuclear aromatic compounds resulting from step (c) to said hydrocracking zone.

2. The process of claim 1 wherein said hydrocarbon feedstock comprises vacuum gas oil.

3. The process of claim 1 wherein said hydrocracking zone is maintained at a pressure from about 1000 psig to about 3000 psig.

4. The process of claim 1 wherein said hydrocracking zone is maintained at a temperature from about 500° F. to about 775° F.

5. The process of claim 1 wherein said metal promoted crystalline zeolite hydrocracking catalyst comprises synthetic faujasite.

6. The process of claim 1 wherein said metal promoted crystalline zeolite hydrocracking catalyst comprises nickel and tungsten.

7. The process of claim 1 wherein said adsorbent is silica gel, activated carbon, activated alumina, silica-alumina gel, clay, molecular sieves or admixtures thereof.

8. The process of claim 1 wherein said unconverted hydrocarbon oil containing polynuclear aromatic compounds is contacted with said adsorbent at conditions which include a pressure from about 25 psig to about 500 psig, a temperature from about 100° F. to about 500° F. and a liquid hourly space velocity from about 0.5 to about 400.

* * * * *